US007168377B2

(12) United States Patent
Fukuyama

(10) Patent No.: US 7,168,377 B2
(45) Date of Patent: Jan. 30, 2007

(54) WIG MAKING NEEDLE

(75) Inventor: Kohki Fukuyama, Tokyo (JP)

(73) Assignee: Propia Co., Ltd., Tokyo (JP)

( * ) Notice: Subject to any disclaimer, the term of this patent is extended or adjusted under 35 U.S.C. 154(b) by 157 days.

(21) Appl. No.: 10/505,854

(22) PCT Filed: Jan. 24, 2003

(86) PCT No.: PCT/JP03/00663

§ 371 (c)(1),
(2), (4) Date: Aug. 26, 2004

(87) PCT Pub. No.: WO03/071889

PCT Pub. Date: Sep. 4, 2003

(65) Prior Publication Data

US 2005/0223956 A1 Oct. 13, 2005

(30) Foreign Application Priority Data

Feb. 28, 2002 (JP) ..... 2002-053819

(51) Int. Cl.
*D05C 15/02* (2006.01)
*D05B 85/00* (2006.01)

(52) U.S. Cl. ..... 112/80.02; 112/222

(58) Field of Classification Search ..... 112/222, 112/223, 116, 80.02, 64; 606/139, 181, 222, 606/223; 66/116–124
See application file for complete search history.

(56) References Cited

U.S. PATENT DOCUMENTS 2,689,575 A * 9/1954 Gerbaud ..... 112/80.02
2,977,906 A * 4/1961 Follender ..... 112/80.02
3,005,428 A * 10/1961 Vom Lehn et al. ..... 112/222
3,327,498 A * 6/1967 Matthews ..... 66/121
3,521,583 A * 7/1970 Pozzolo ..... 112/64
3,710,740 A * 1/1973 Canziani ..... 112/80.02
4,790,254 A * 12/1988 Vornholt ..... 112/222
5,215,021 A * 6/1993 Fuhrmann ..... 112/222

FOREIGN PATENT DOCUMENTS

JP 63220889 * 9/1988

* cited by examiner

*Primary Examiner*—Ismael Izaguirre
(74) *Attorney, Agent, or Firm*—Keusey, Tutunjian & Bitetto, P.C.

(57) ABSTRACT

A vertically reciprocatable needle (41) that is extremely fine in its lengthwise direction, having a leading end portion of a triangular pyramidal shape. Edges (41*b*) are formed on a periphery of the leading end portion, and an engaging portion (41*c*) is formed at a base thereof. The engaging portion comprises a recess (41*d*) and a tongue (41*e*) covering the recess. Below the engaging portion, a tapered guide surface (41*f*) continues straight from a point on a periphery of the needle to the recess. The recess is recessed in a needle axial direction. The tongue has a diameter smaller than the maximum diameter of the guide surface. The artificial hair may be hooked by the engaging portion during vertical movement of the needle, which assures relative movement of the needle at a pitch or width of high accuracy. Accordingly, the transplanting pitch of the artificial hair is controlled with high accuracy.

16 Claims, 18 Drawing Sheets

ENLARGED VIEW OF A' PART

WIG MAKING NEEDLE

TECHNICAL FIELD

The present invention relates to automation of wig manufacturing and more particularly to a needle for manufacturing a wig to be used in an automated hair-transplanting apparatus for manufacturing a wig.

BACKGROUND

A wig has been manufactured in such a manner that a hair segment to be transplanted is folded in two, which is one by one transplanted onto a three-dimensional thick base by handwork. When one folded hair segment is transplanted on the base, it looks as if two hairs are transplanted. Several folded hair segments may be transplanted at one time.

However, such a prior art handwork is extremely inefficient. It would take two or three weeks or more to transplant 20,000 hairs, for example. When a wig is manufactured in foreign countries in order to save labor costs, it tends to increase inferior products and reduce a production yield.

Some attempts have been made to develop automated wig manufacturing systems, but no success has been achieved.

According to the study by the present inventor, the greatest difficulty in automation of wig manufacturing exists in providing high-precision transplanting pitch. Human hairs are, in their natural condition, spaced from each other by less than 1 mm, or normally of the order of 0.5 mm, so that it will be desired to determine the transplanting pitch as such.

However, it is quite difficult, like a divine work, to operate an extremely thin needle at a pitch of lower than 1 mm along a predetermined line. When the needle should be wobbling even a little, the needle holes are connected with each other to form a continuous slit, thereby making it impossible to transplant hair segments onto a base.

More importantly, when the needle is to penetrate the base, it pushes the base, so that the needle would move and wobble.

If the needle should wobble, the hair segment cannot surely be hooked by the needle.

After repeated trial and error in development of automated wig manufacturing apparatus which is the first in the world, the present inventor has reached a conclusion that a keyword is an issue of the needle wobbling.

The present invention has been made in view of the above-described background, with the object to surely hook the hair segment with the needle in automated wig manufacturing. Another object is to control the transplanting pitch of the hair segment with great accuracy. Still another object is to reduce a percentage of production of defective articles when automatically manufacturing wigs.

DISCLOSURE OF INVENTION

To achieve the above-described object, a needle for manufacturing a wig in accordance with the present invention, said needle being used in an automated hair-transplanting apparatus for manufacturing a wig, said needle being extremely fine in its lengthwise direction, said needle having a gimlet-shaped leading end portion provided with edge(s) on a periphery thereof and with an engaging portion at a base thereof, wherein there is a tapered guide surface extending from said engaging portion toward another end opposite to said leading end portion, said guide surface continuing straight from a point on a periphery of the needle to the recess, said needle comprising a pair of needles of the same shape which vertically move together with respect to a base. By such construction, when the needle is to penetrate a base it will smoothly penetrate a base while not imparting a pushing force to the base, thereby preventing the needle wobbling and assuring the hooking of the hair segment. Moreover, the hair segment once hooked and supported by the needle can smoothly be separated therefrom. Further, relative movement of the needle may be achieved at a pitch or width of high accuracy. Accordingly, it becomes possible that the transplanting pitch of the hair segment in automated wig manufacturing is controlled with high accuracy to be as equal to the human hair spacing in the natural condition, for example, thereby reducing a percentage of production of defective articles in automated wig manufacturing.

In the wig-manufacturing needle according to the present invention, the engaging portion preferably comprises a recess and a tongue covering the recess. The recess is recessed preferably in an axial direction of the needle.

Preferably, there is a tapered guide surface extending from the engaging portion toward another end opposite to the leading end portion. The guide surface continues straight from a point on a periphery of the needle toward the recess. The tongue has a diameter preferably smaller than the maximum diameter of the guide surface.

Preferably, one of the needle and the base is vertically movable with respect to the other.

The leading end portion of the needle is preferably shaped like a polyangular pyramid such as a triangular pyramid or a cone. The number of the edges is preferably one or more, for example three. The respective edges are preferably equally spaced with each other. The edge is preferably a straight extending one or a screw-like one.

The needle preferably comprises a pair of needles. The needle is supported preferably at two points. The needle is preferably positioned below a base supplied to the automated hair-transplanting apparatus for wig manufacturing, wherein the needle cooperates with a head mounted just above the needle to constitute a hair-transplanting unit of the automated hair-transplanting apparatus for wig manufacturing.

BRIEF DESCRIPTION OF DRAWINGS

FIG. 1 shows an embodiment of a needle for manufacturing a wig in accordance with the present invention, wherein

FIG. 2 is a general view showing an embodiment wherein the wig-manufacturing needle is applied to an automated hair-transplanting apparatus for wig manufacturing, which also diagrammatically shows a process flow.

FIG. 4 shows an example of tensioning/positioning unit of the automated hair-transplanting apparatus for wig manufacturing shown in FIG. 2, wherein FIG. 2(B) is a general front view and FIG. 2(C) is a general plan view showing a main part.

FIG. 9 is a diagrammatic side view showing an example of a blowing unit of the automated hair-transplanting apparatus for wig manufacturing shown in FIG. 2, wherein FIG. 9(A) shows the condition immediately after the hair segments have been transplanted, whereas

FIG. 12 shows the step of needle elevation when the needle is applied to the automated hair-transplanting apparatus for wig manufacturing shown in FIG. 2, wherein

FIG. 13 is a view showing the step of needle descent, when the needle is applied to the automated hair-transplanting apparatus for wig manufacturing shown in FIG. 2, wherein

FIG. 16 shows an example of an electromagnetic valve for use in the automated hair-transplanting apparatus for wig manufacturing shown in FIG. 2, wherein

DETAILED DESCRIPTION OF PREFERRED EMBODIMENTS

Figure 1F:
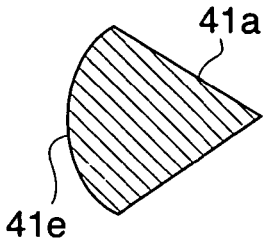
FIG. 1(F) is an enlarged cross-section taken along F—F in FIG. 1(B).
Figure 1D:
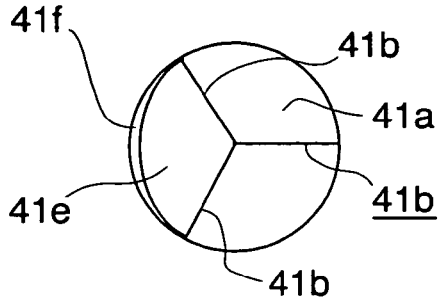
FIG. 1(D) is an enlarged plan view of FIG. 1(B)
Figure 1E:
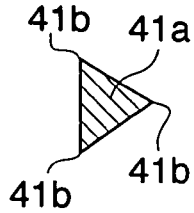
FIG. 1(E) is an enlarged cross-section taken along E—E in FIG. 1(B)
Figure 1A:
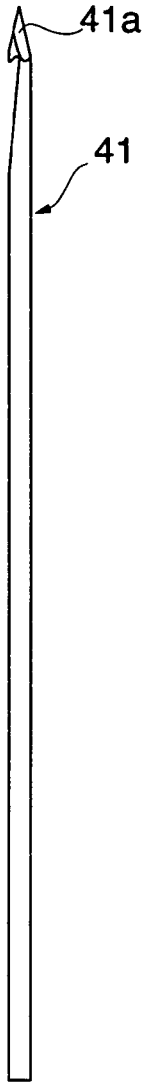
FIG. 1(A) is a front view.
Figure 1B:
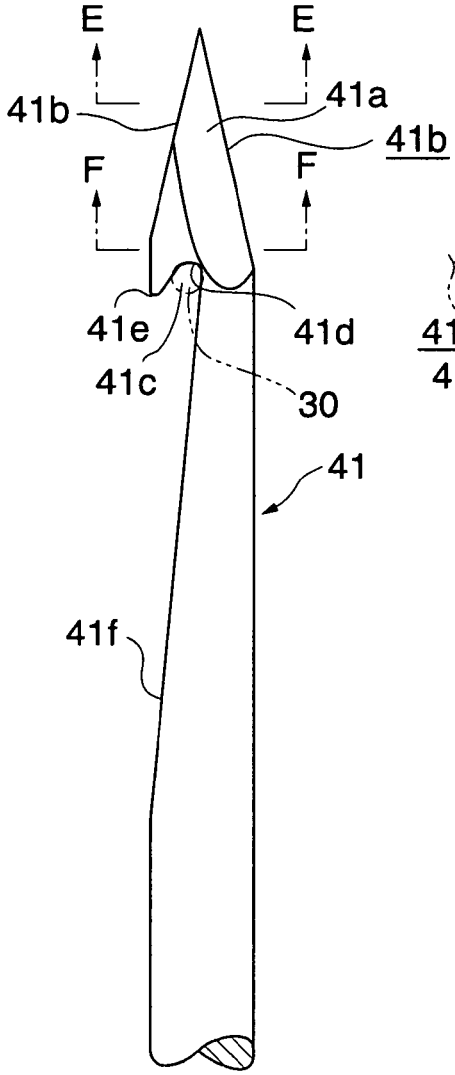
FIG. 1(B) is an enlarged view showing a leading end portion.
Figure 1C:
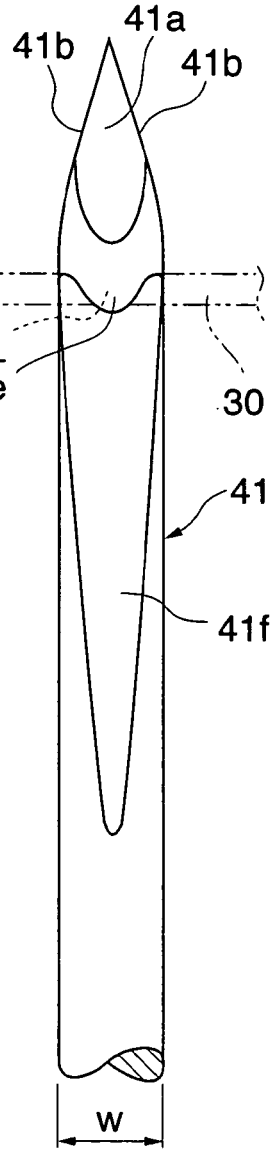
FIG. 1(C) is a left side view of FIG. 1(B)

Next, a wig-manufacturing needle according to the present invention will be described in more detail in reference to the accompanying drawings showing embodiments thereof. For the sake of convenience, elements or parts having the same function are indicated by the same reference numerals and explanation thereof will be omitted.

FIG. 1 shows an embodiment of a wig-manufacturing needle according to the present invention. Needle 41 is formed to be extremely thin in its lengthwise direction. A diameter W of needle 41 generally corresponds to spacing between human hairs in natural condition, which is for example less than 0.5 mm. Needle 41 has a leading end portion 41*a* shaped substantially into an equilaterally triangular pyramid. There are edges or knives 41*b* on a periphery of leading end portion 41*a*. Each edge 41*b* extends straight, and there is an equal spacing between edges 41*b*. Just below leading end portion 41*a*, there is an engaging portion 41*c*. Engaging portion 41*c* comprises a recess 41*d* recessed in an axial direction and a tongue 41*e* covering recess 41*d*. Tongue 41*e* is substantially semi-circular and mounted in opposition to one edge 41*b* (edge 41*b* underlined in FIG. 1(B) and FIG. 1(D)). Below engaging portion 41*c* is provided a tapered guide surface 41*f*. Guide surface 41*f* continues and extends from a point on the periphery of needle 41 to recess 41*d*. As shown in FIG. 1(D), tongue 41*e* has a smaller diameter than the maximum diameter of guide face 41*f*. Guide surface 41*f* is gently tapered. In this embodiment, guide surface 41*f* is approximately 2.5 times longer than leading end portion 41*a*.

Needle 41 of the above-construction is made from hard metal, for example.

Wig-manufacturing needle 41 according to the present invention is used as a member mounted to an automated hair-transplanting apparatus for wig manufacturing. Next, wig-manufacturing needle 41 according to the present invention will be described in detail, wherein it is applied to the automated hair-transplanting apparatus for wig manufacturing shown by way of example in FIG. 2 and the followings.

Figure 2A:
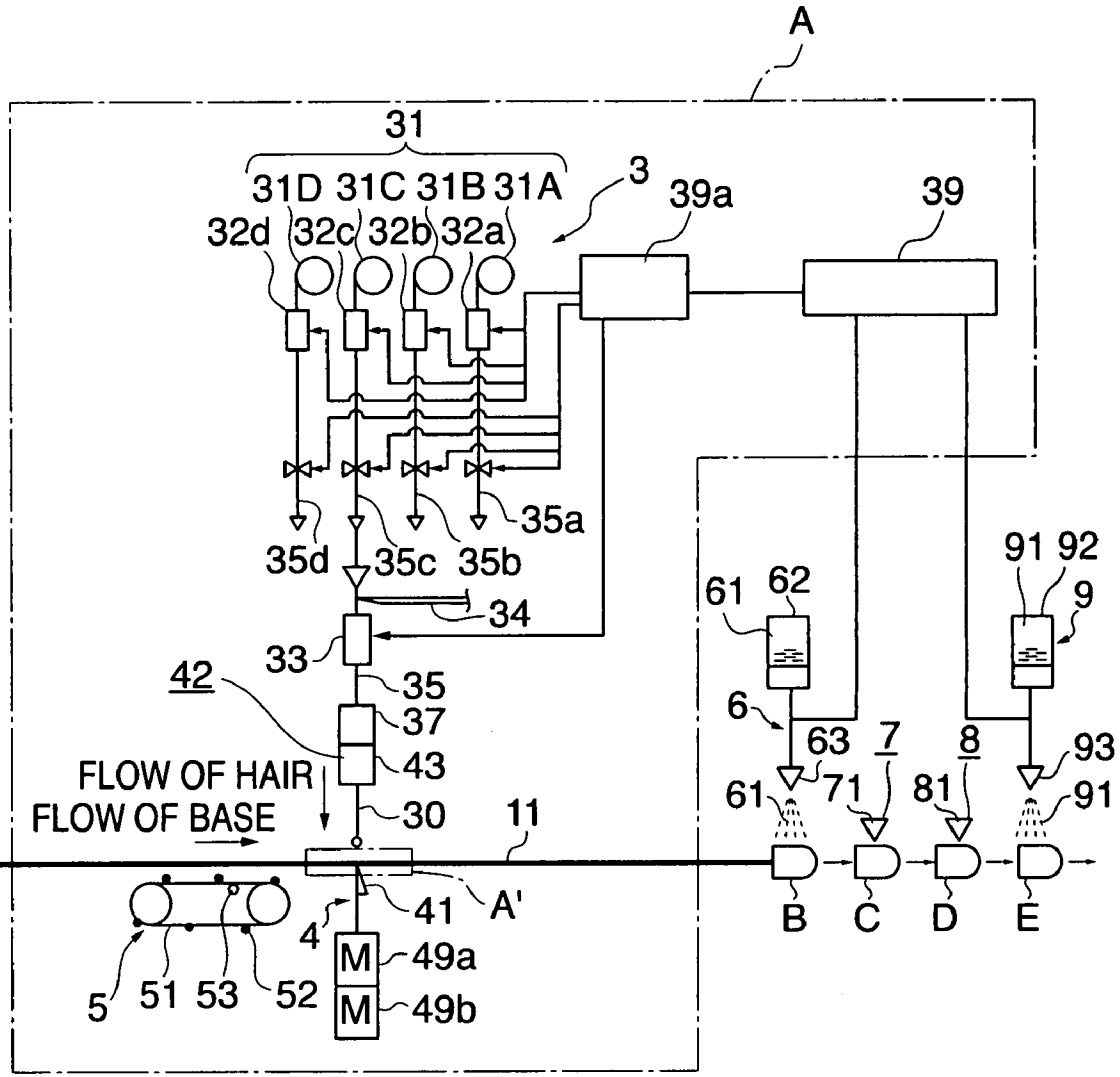
FIG. 2(A) is a general plan view.
Figure 2B:
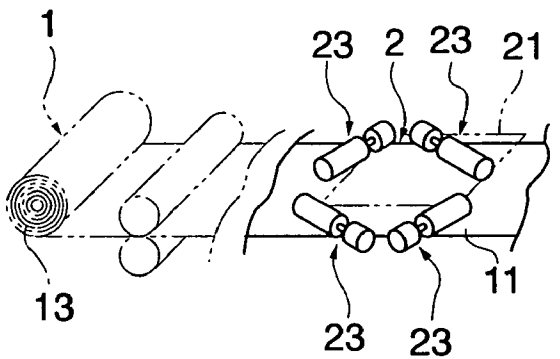
Figure 3:
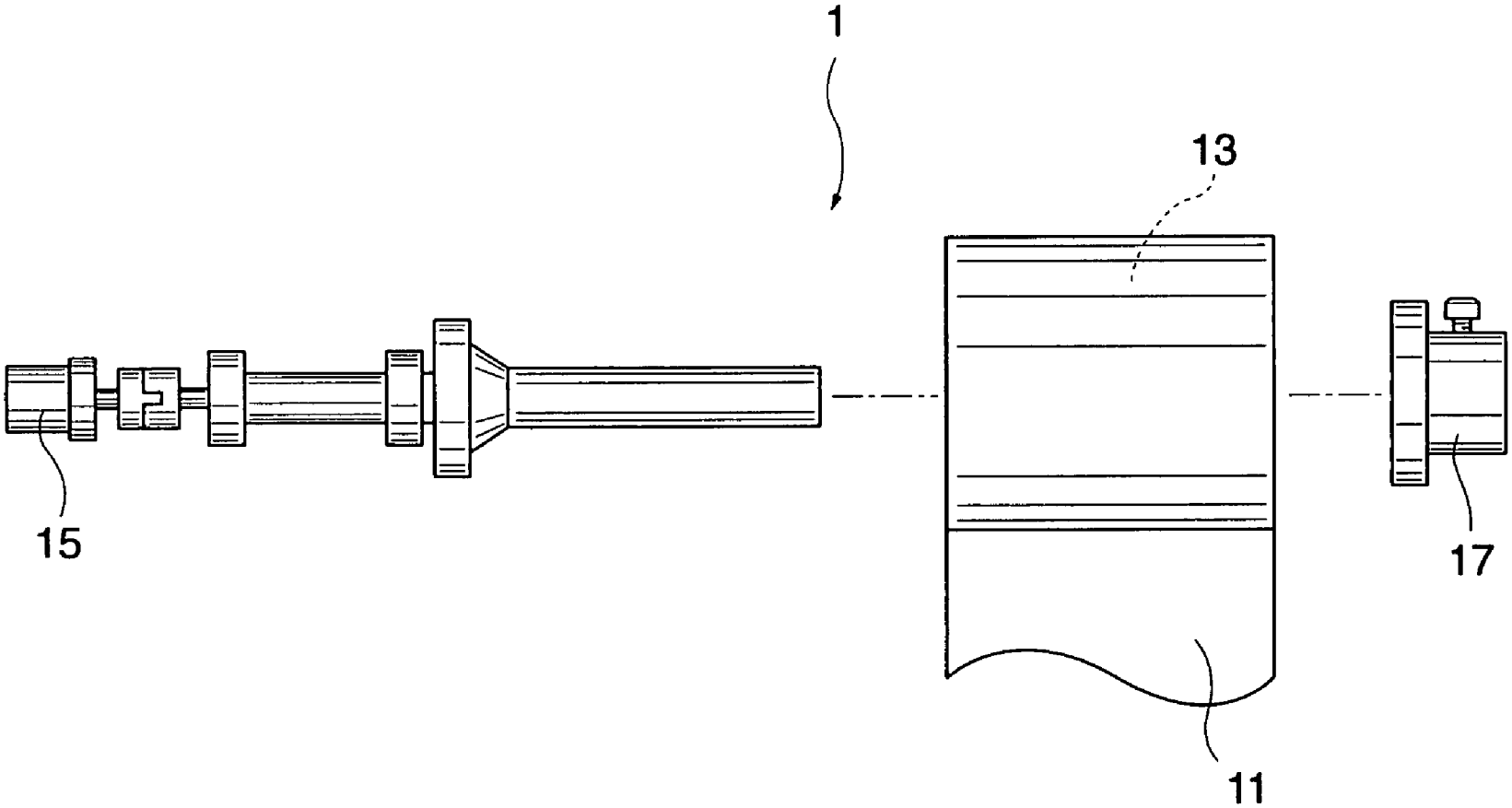
FIG. 3 is a diagrammatic front view showing an example of a base supply unit of the automated hair-transplanting apparatus for wig manufacturing shown in FIG. 2.

FIG. 2 is a general view diagrammatically showing the automated hair-transplanting apparatus for wig manufacturing, along with the operation process. A base supply unit 1 supplies a base 11 to a tensioning/positioning unit 2 in a horizontal orientation. Base 11 is a sheet made from polyurethane, for example, which is very thin having thickness of 0.06 mm, for example. It is reeled around a sheet roller 13. Sheet roller 13 is driven by a motor 15, shown in FIG. 3, to supply the reeled base 11 therefrom onto a conveyor table 21. A reference numeral 17 indicates a sheet roller stopper.

Figure 4A:
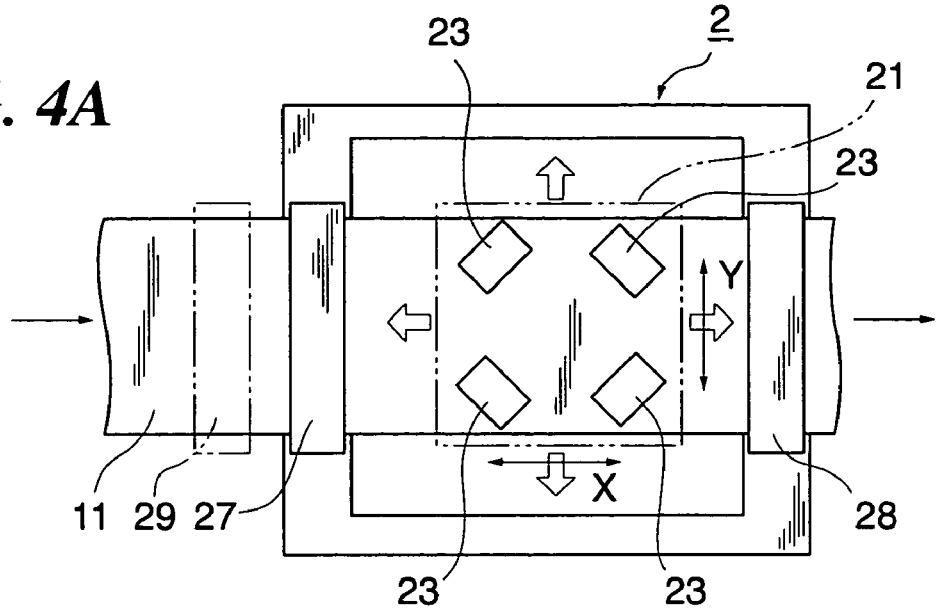
Figure 4B:
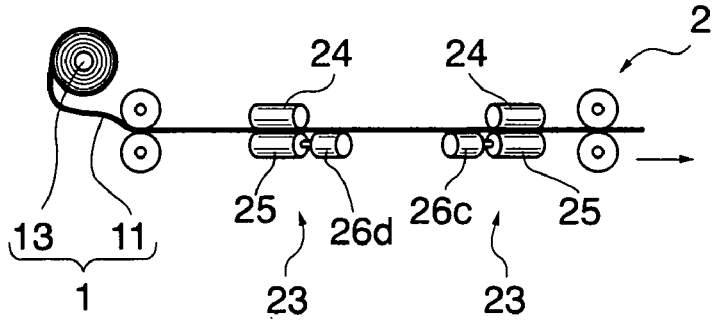
Figure 4C:
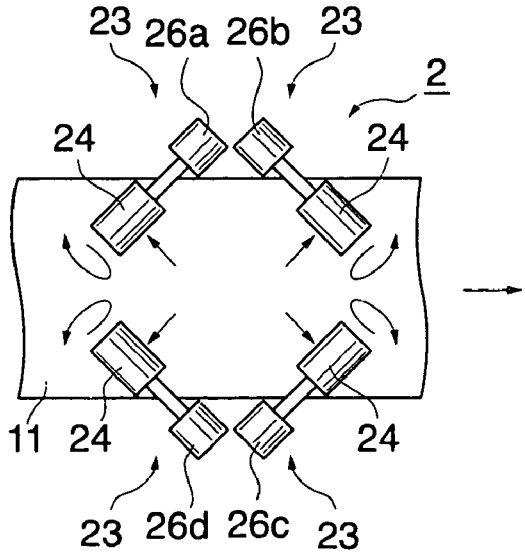

FIG. 4 shows the tensioning/positioning unit 2. Tensioning/positioning unit 2 has conveyor table 21 movable on a two-dimensional plane in directions perpendicular to each other, that is, along X- and Y-axes. Conveyor table 21 is moved along X- and Y-axes over predetermined travel pitch of the order of 1 mm, for example, by an X-axis drive motor (not shown) and a Y-axis drive motor (not shown), respectively, in a predetermined order. By this, base 11 becomes stretched and is positioned in a predetermined position. More particularly, there are tensioners 23 at four corners on conveyor table 21 for tensioning the supplied base 11. Each tensioner 23 comprises a pair of opposed tension nip rollers 24, 25 for pressing and clamping base 11 from up and down, and tensioning motors 26 (26*a*, 26*b*, 26*c*, 26*d*) that may be rotated in forward and reverse directions to drive rollers 24, 25. A reference numeral 27 indicates upper and lower sheet feeding rollers arranged at a supply side of tensioning/positioning unit 2, which are driven by a motor 27*a*, shown in FIG. 15, to rotate in one predetermined direction for feeding base 11 onto conveyor table 21. A reference numeral 28 indicates upper and lower sheet discharging rollers arranged at a discharge side of tensioning/positioning unit 2, which is rotatable in forward and reverse directions by a motor 28*a* shown in FIG. 15. A reference numeral 29 indicates a sheet slack sensor mounted at the supply side of tensioning/positioning unit 2, upstream of sheet feeding rollers 27, for detecting a slack of the supplied base 11.

Figure 5:
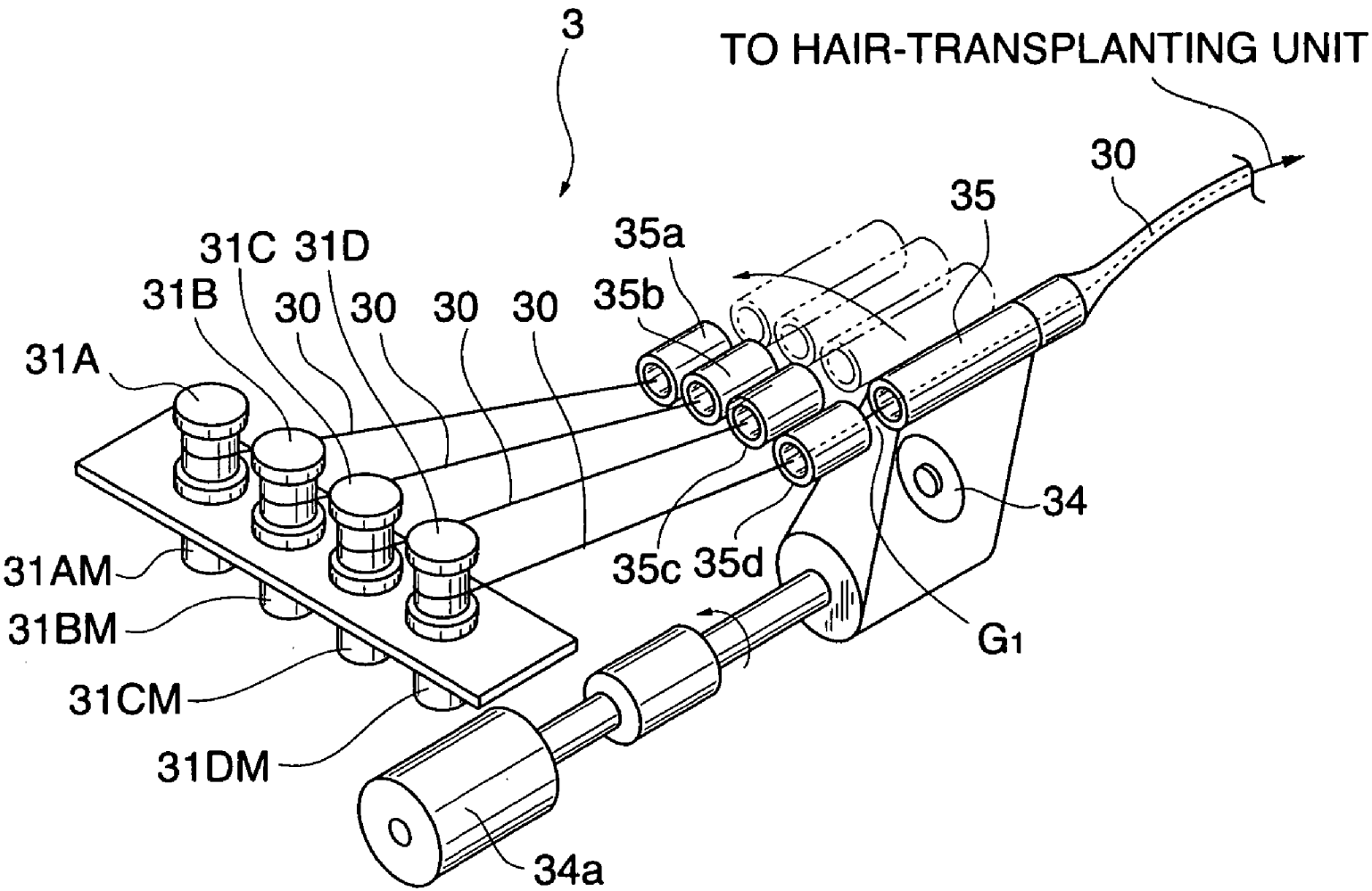
FIG. 5 is a general perspective view showing an example of a hair color selecting and cutting unit that is a part of a hair-segment supplying unit of the automated hair-transplanting apparatus for wig manufacturing shown in FIG. 2.

An artificial hair supplying unit 3 shown in FIG. 5, including bobbins 31A, 31B, 31C and 31D (which may be hereinlater referred to by a bobbin with a generic numeral 31), supplies an artificial hair 30 onto the upper surface of base 11. A thread (artificial hair 30) of a different color is reeled around each bobbin 31, which may be unreeled from the bobbin over a predetermined length by an unreeling motor 31AM, 31BM, 31CM, 31DM. The unreeled thread is fed by actuating a vacuum generator 32*a*, 32*b*, 32*c*, 32*d* (which may be heinlater referred to by a vacuum generator with a generic numeral 32) and a single vacuum generator 33, shown in FIG. 2. Each bobbin system 31 has a conduit 35*a*, 35*b*, 35*c*, 35*d* that forms a travel path, and artificial hairs 30 are supplied through conduit 35*a*, 35*b*, 35*c*, 35*d* and a conduit 35 to a hair-transplanting unit 4. As shown In FIG. 5, in the middle of each travel path, there is a movable cutter 34 driven by a cutter motor 34*a* for cutting the respective artificial hairs 30 after they are unreeled over a predetermined length by unreeling motors 31AM, 31BM, 31CM, 31DM. Between conduit 35 and conduits 35*a*, 35*b*, 35*c*, 35*d* are formed gap G1 that allows cutter 34 to pass therethrough. Artificial hair 30 may comprise, for example, polyester, acrylic or other chemical fiber that has been subjected to special treatment for use as an artificial hair. The respective artificial hairs 30 are supplied through conduit 35.

Figure 6:
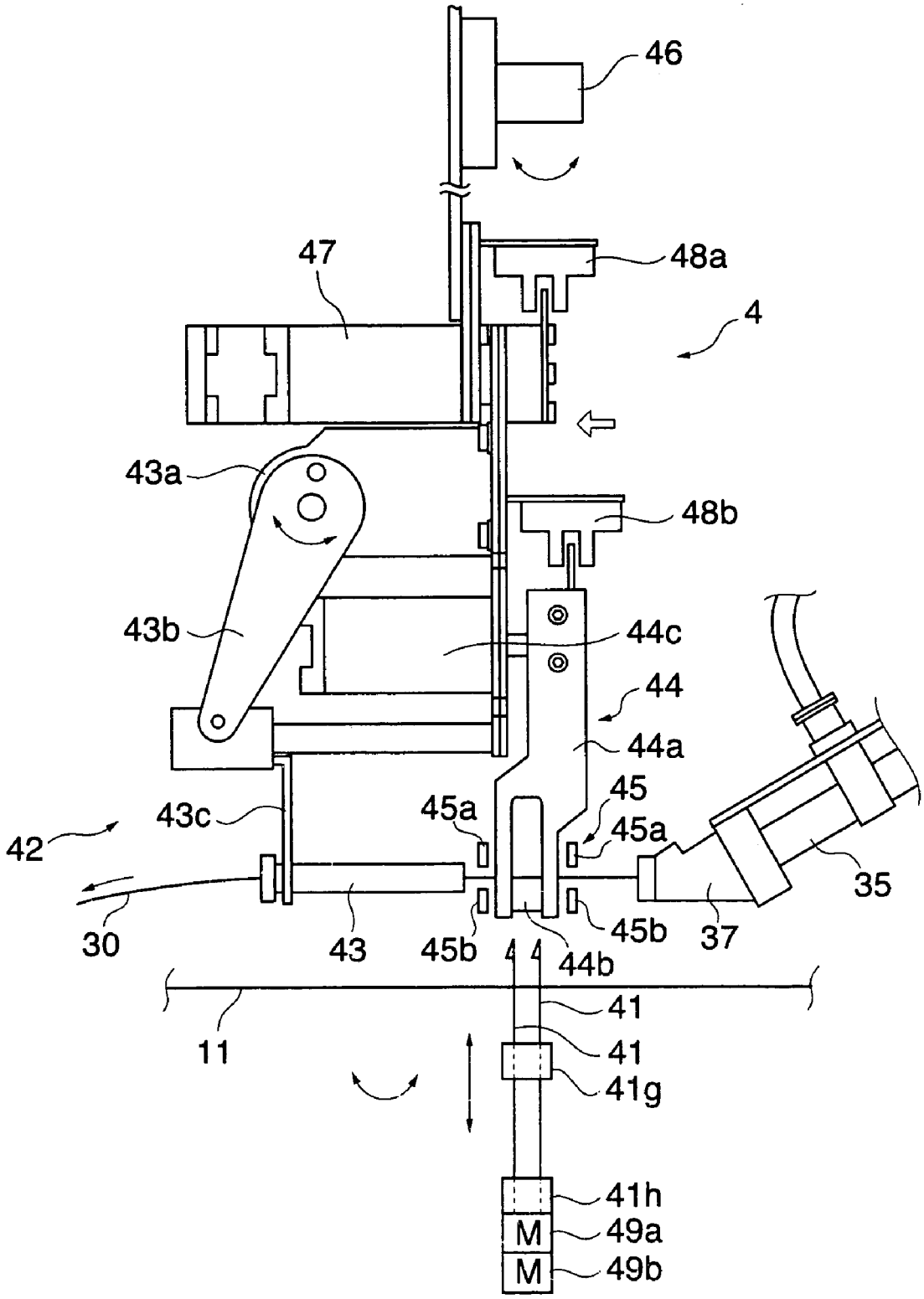
FIG. 6 is a front view showing an example of a hair-transplanting unit of the automated hair-transplanting apparatus for wig manufacturing shown in FIG. 2.
Figure 7A:
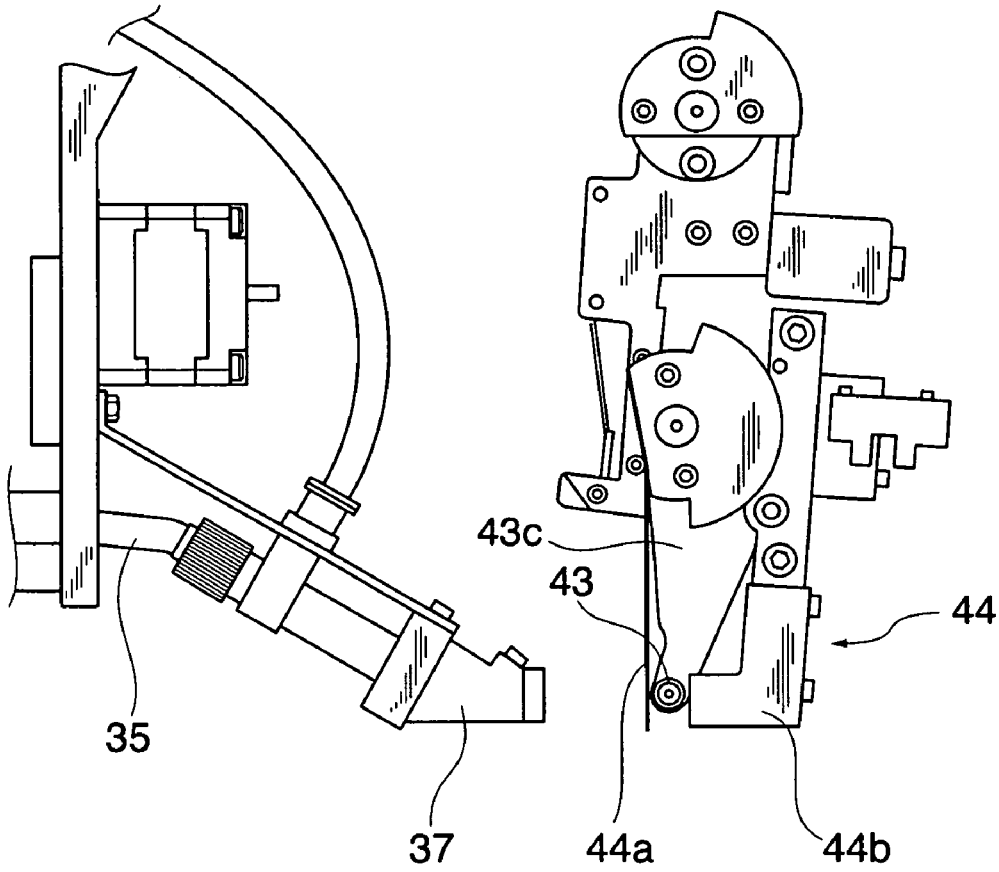
FIG. 7(A) is a side view of FIG. 6.
Figure 7B:
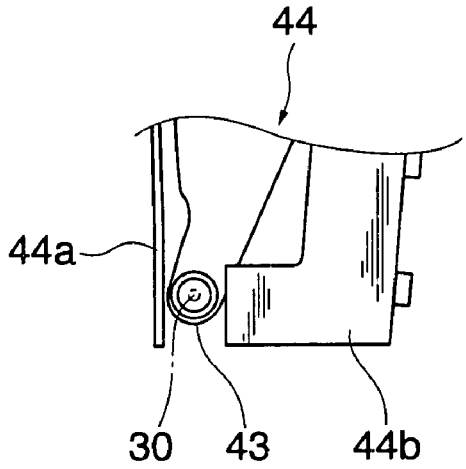
FIG. 7(B) is an enlarged view showing a part thereof when presser means is opened.
Figure 7C:
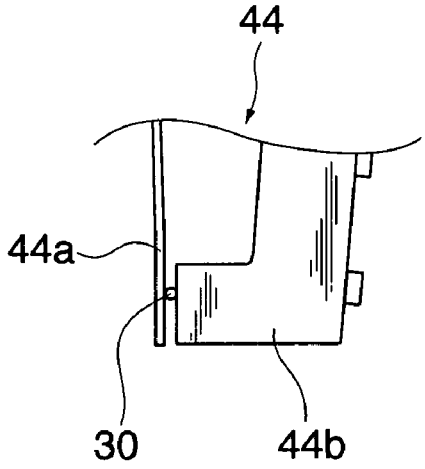
FIG. 7(C) is an enlarged view showing the same part when presser means is closed.
Figure 8:
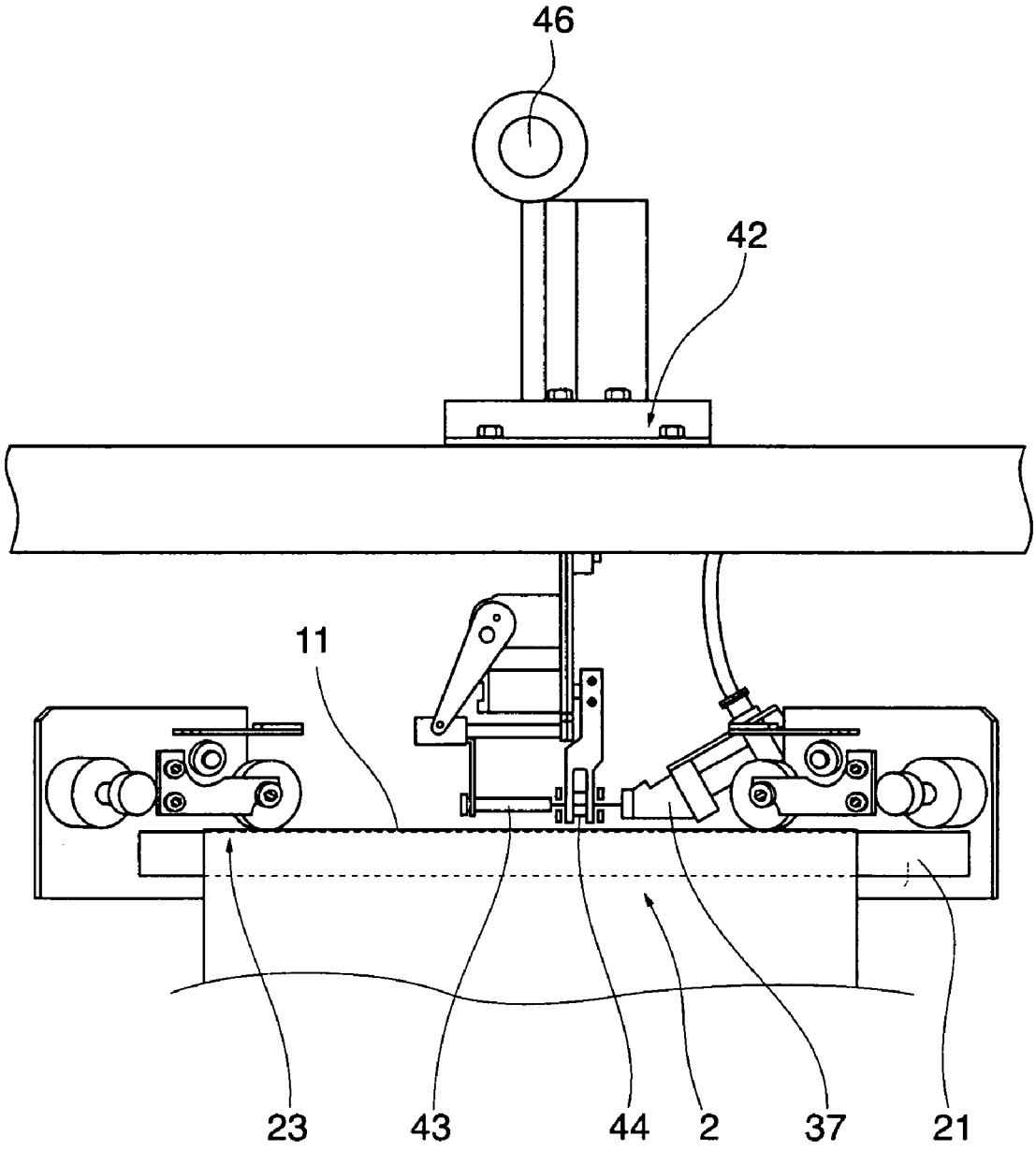
FIG. 8 is a diagrammatic perspective view showing relationship between a head unit and a conveyor table of the automated hair-transplanting apparatus for wig manufacturing shown in FIG. 2.

FIG. 6 through FIG. 8 show hair-transplant unit 4. Hair-transplant unit 4 comprises the aforementioned needle 41 arranged below base 11 and a head 42 arranged above base 11 and just above needle 41. Needle 41 comprises two needles 41*a*, 41*b* mounted to a vertically reciprocatable needle holder 41*g*, 41*h* with a predetermined gap of 1 mm, for example, between the needle centers. Needle 41 is supported at two points by upper and lower needle holders 41*g*, 41*h*, which reciprocates up and down by moving needle holders 41*g*, 41*h* in up and down directions. The head 42 is provided with a movable guide 43 in the form of a pipe detachably connected to an artificial hair supplying nozzle 37 attached to the leading end of conduit 35, and press means 44, 45 that may be opened and closed for clamping artificial hair 30 that has been removed from movable guide 43 and artificial hair supplying nozzle 37, which is driven by a motor 46 to rotate like a pendulum to describe an arc on horizontal plane of base 11. A reference numeral 43*a* indicates a motor for reciprocating movable guide 43 on a horizontal plane, which drives movable guide 43 via a lever 43*b* connected to a motor shaft and a connector plate 43*c*. Press means 44 comprises a movable member 44*a* driven by a motor 44*c* to be opened and closed, and a stationary receiving member 44*b*, between which artificial hair 30 is clamped from opposite sides. Press means 45 comprises members 45*a*, 45*b* that are moved up and down in synchronism with movement of movable member 44*a* to clamp artificial hair 30 therebetween. A reference numeral 47 indicates a motor for swinging head 42, including press means 44, about its axis toward needle 41. A reference numeral 48*a* indicates a sensor for detecting a swinging rotational angle of head 42, which comprises an encoder. A reference numeral 48*b* indicates a sensor for detecting an axial rotational angle of the press means 44, which comprises an encoder. A reference numeral 49*a* indicates a motor for reciprocating the needle 41, and a reference numeral 49*b* indicates a motor operable in synchronism with motor 47 to axially rotate needle 41. In FIG. 6, artificial hair 30 is transferred in an arrowed direction (in a direction of X-axis) with respect to base 11.

Figure 9A:
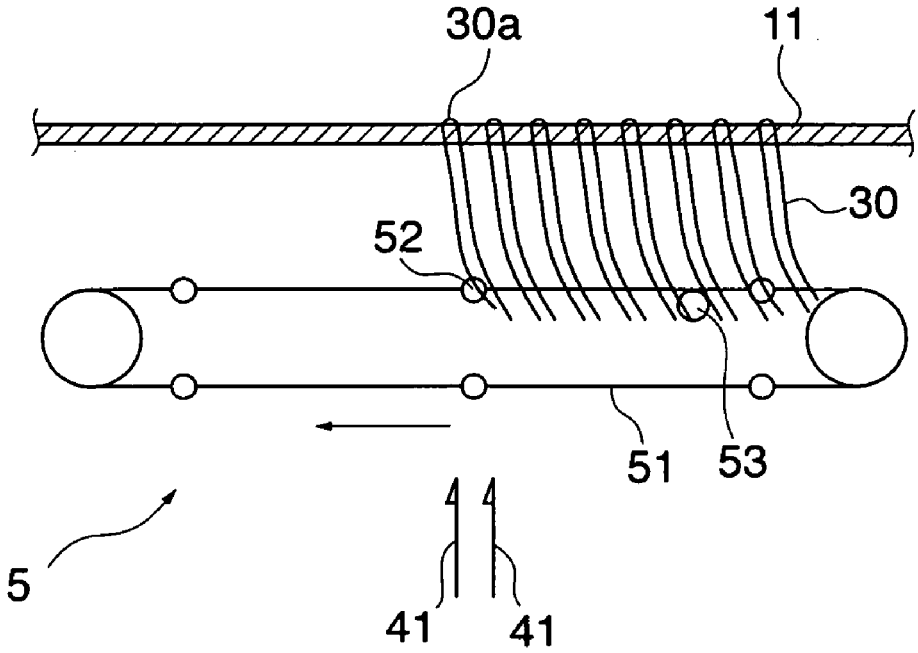
Figure 9B:
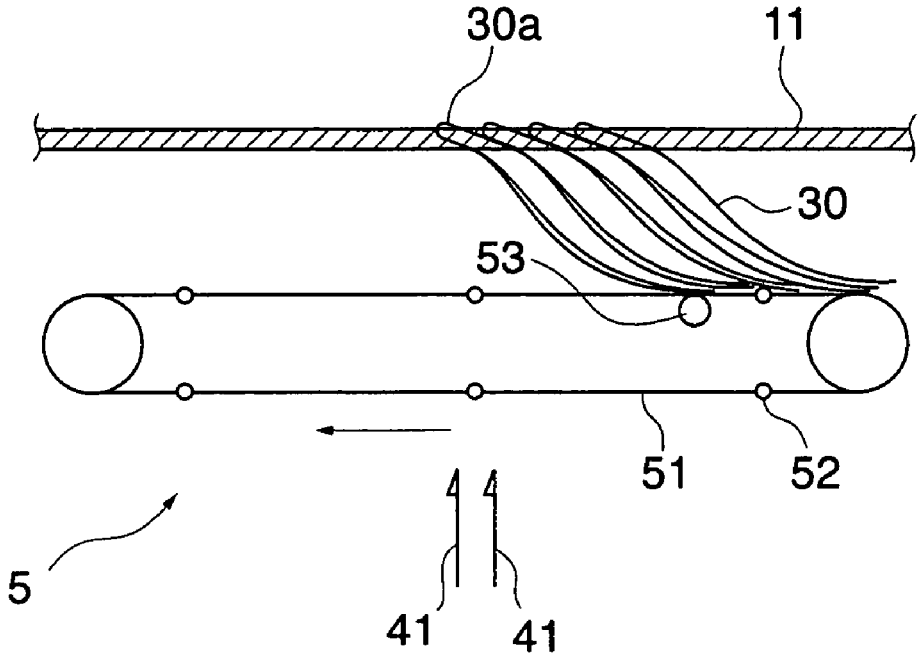
FIG. 9(B) shows the condition wherein the hair segments have been blown toward the base.
Figure 10A:
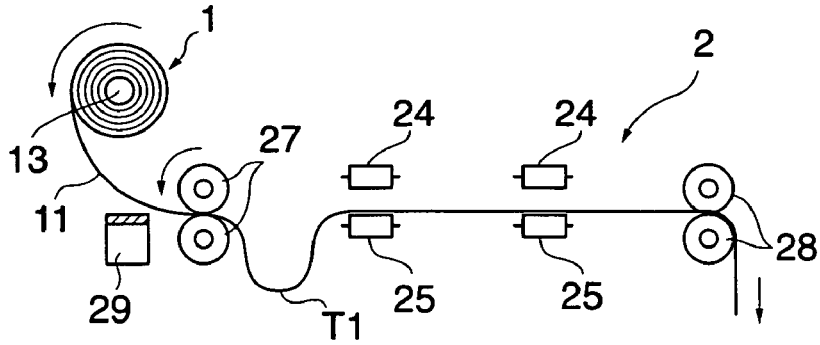
FIGS. 10(A) through 10(D) are (diagrammatic side) view explaining the manner of applying tension to the base.
Figure 10B:
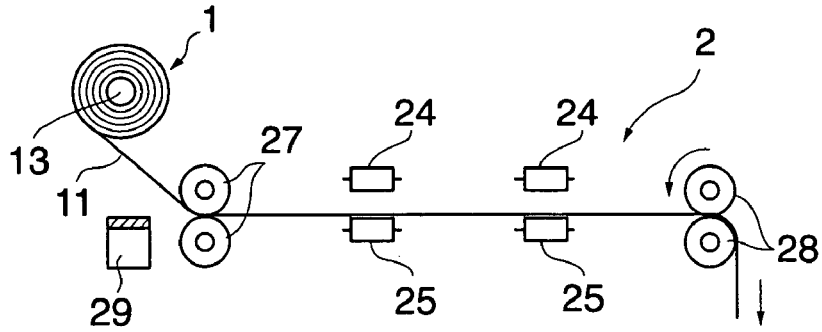
Figure 10C:
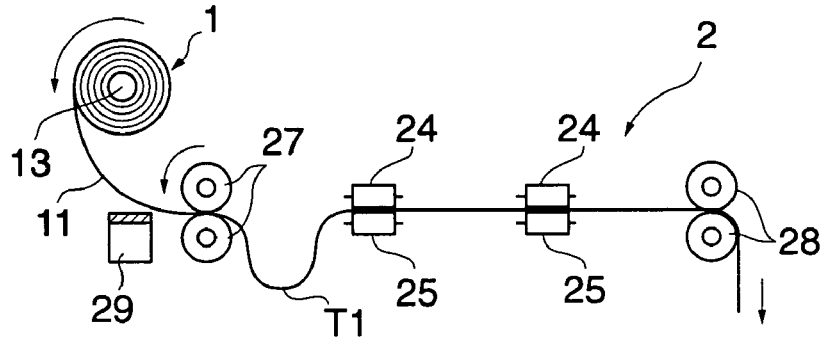
Figure 10D:
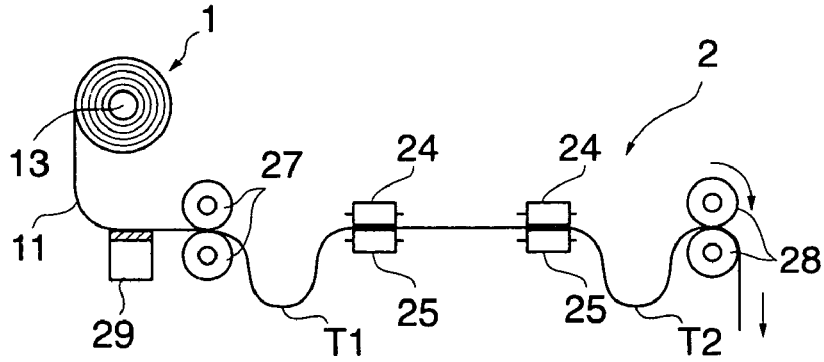
Figure 11A:
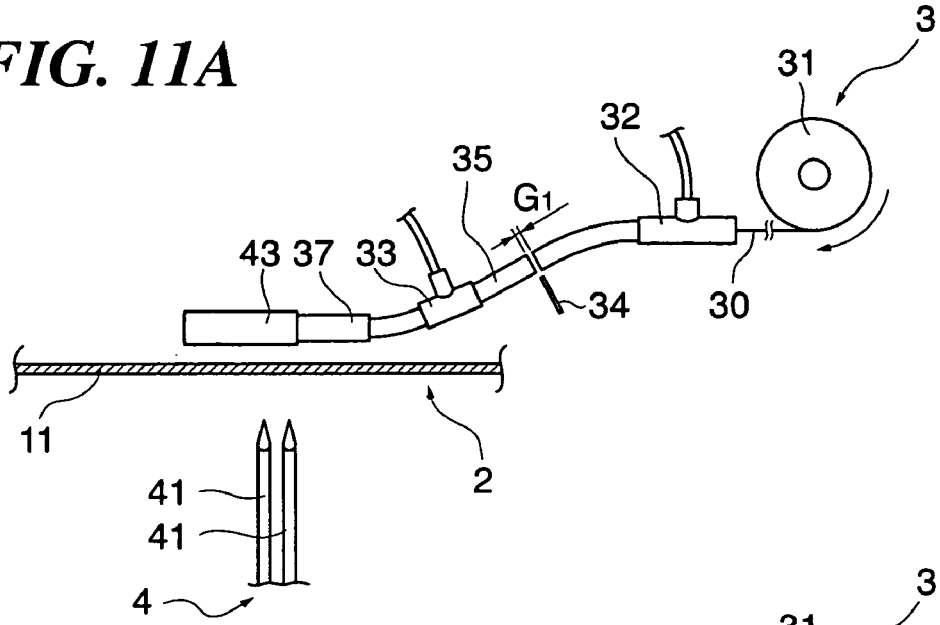
FIGS. 11(A) through 11(D) are diagrammatic front view showing the hair segment supplying process in accordance with the automated hair-transplanting apparatus for wig manufacturing shown in FIG. 2.
Figure 11B:
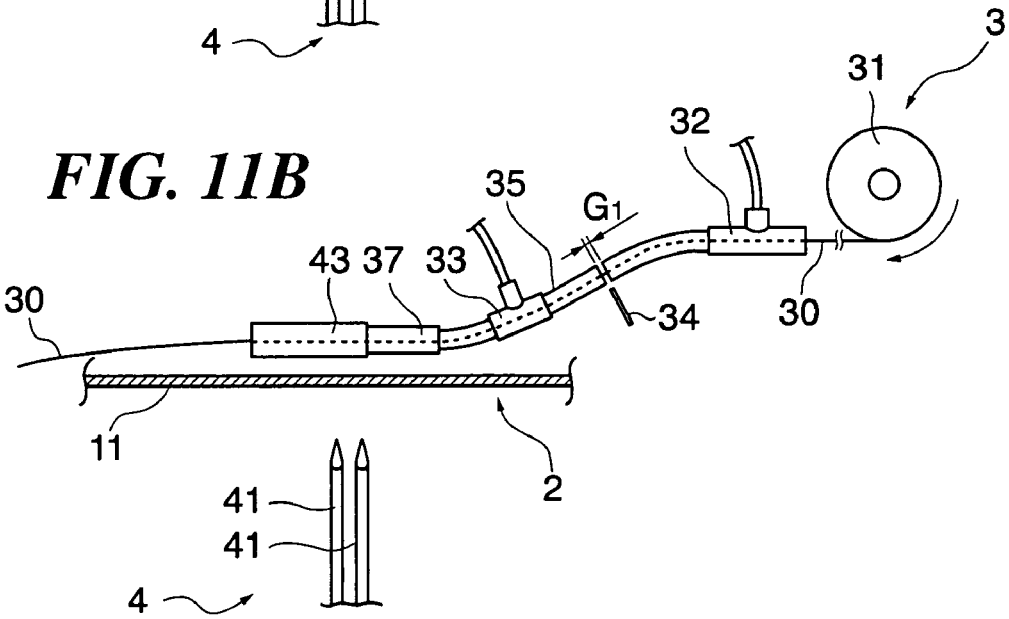
Figure 11C:
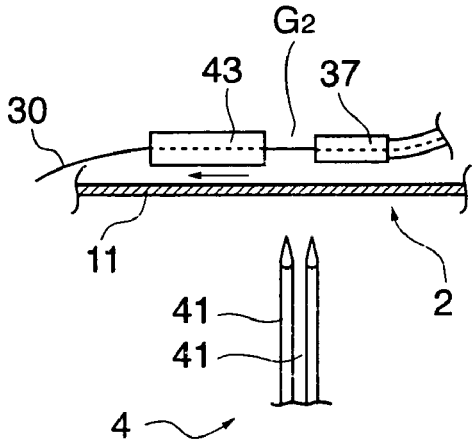
Figure 11D:
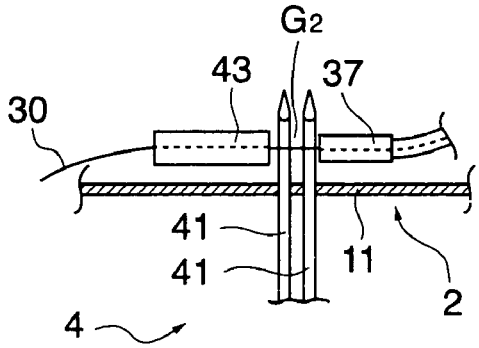
Figure 12A:
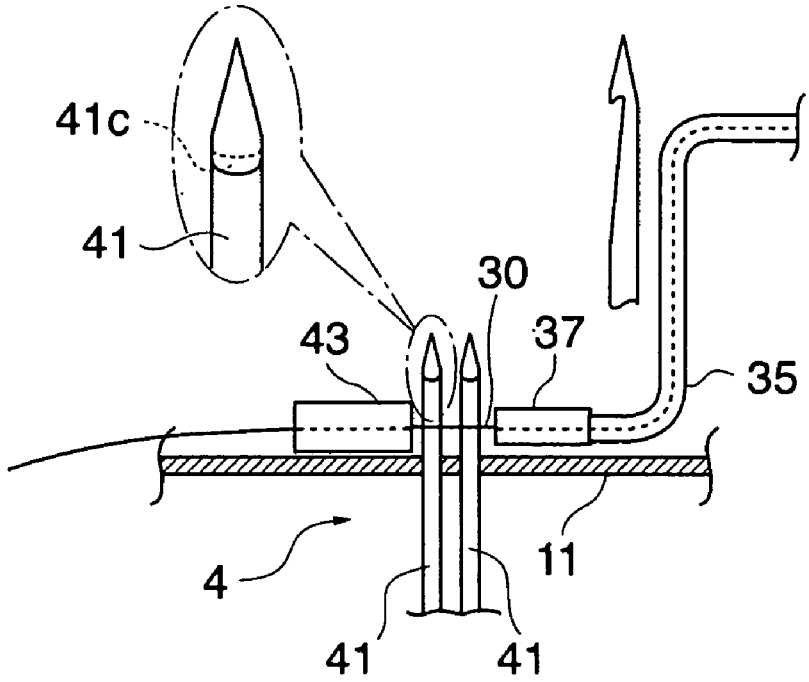
FIG. 12(A) is a diagrammatic front view thereof and FIG. 12(B) is a diagrammatic left side view thereof.
Figure 12B:
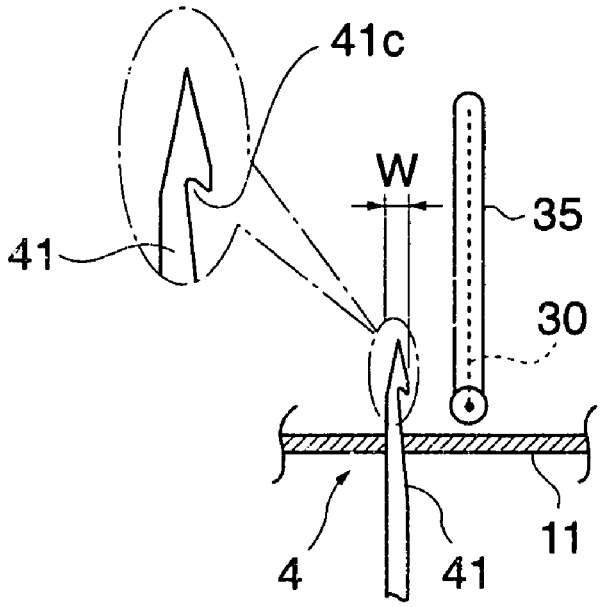
Figure 13A:
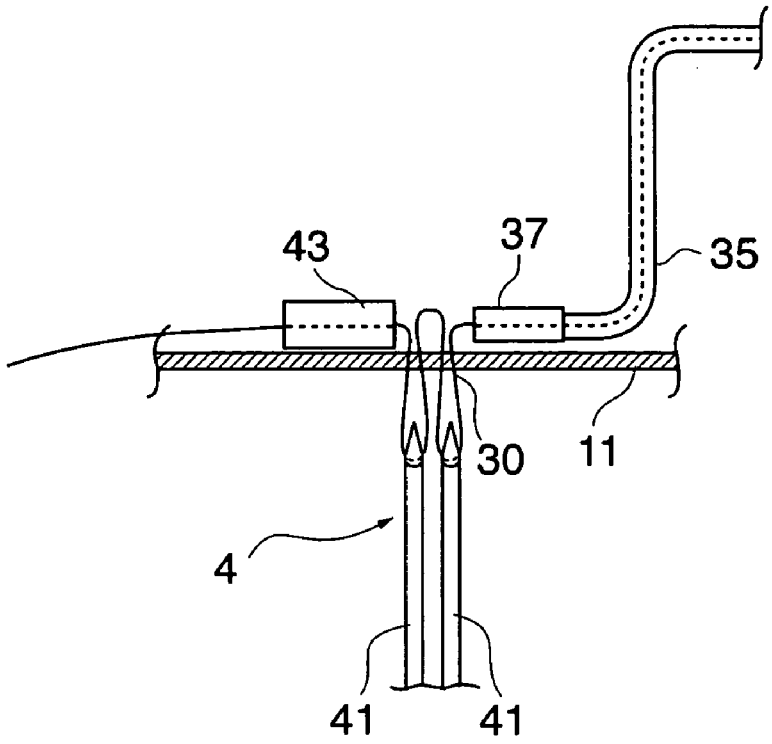
FIG. 13(A) is a diagrammatic front view thereof and FIG. 13(B) is a diagrammatic left side view thereof.
Figure 13B:
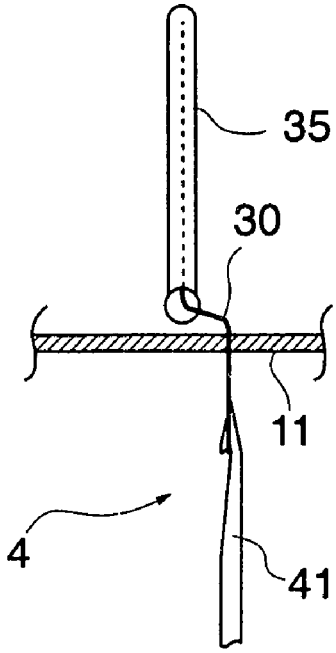
Figure 14:
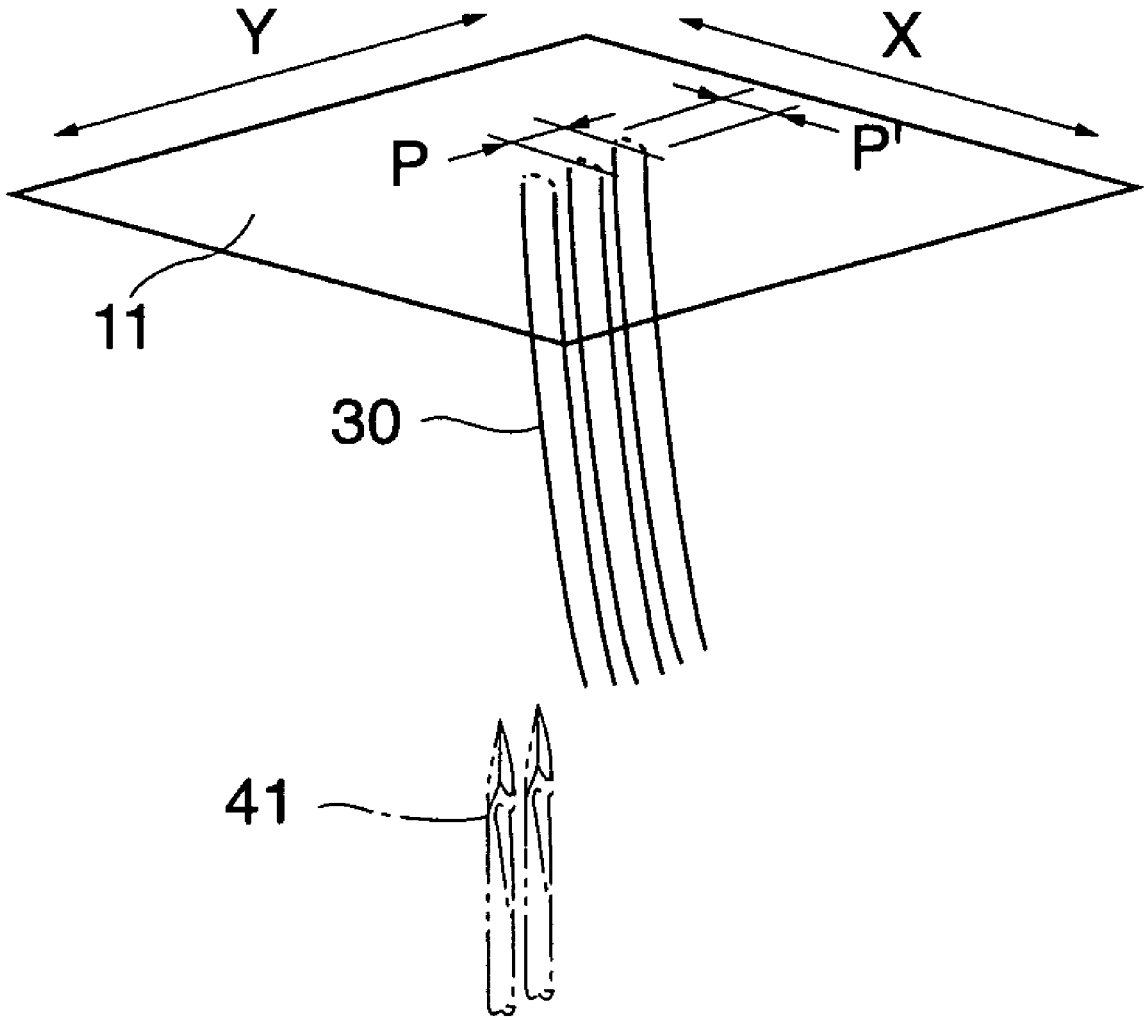
FIG. 14 is a view showing the condition where the hair segments have been transplanted onto the base.

FIG. 9 shows a hair-blowing unit 5 in hair-transplanting unit 4. More particularly, just below the transplanted artificial hair 30 is arranged a chain conveyor 51 that rotates clockwise, and conveyor 51 is provided with a plurality of raking bars 52. A holding bar 53 is suitably separated from the transplanted artificial hairs 30. Conveyor 51 is driven to rotate at a predetermined time interval so that raking bars 52 rake the transplanted artificial hairs 30 to right, which are then held by holding bar 53. This assures that next hair-transplanting operation may be done with no obstacles on an area to be hair-transplanted.

Figure 16A:
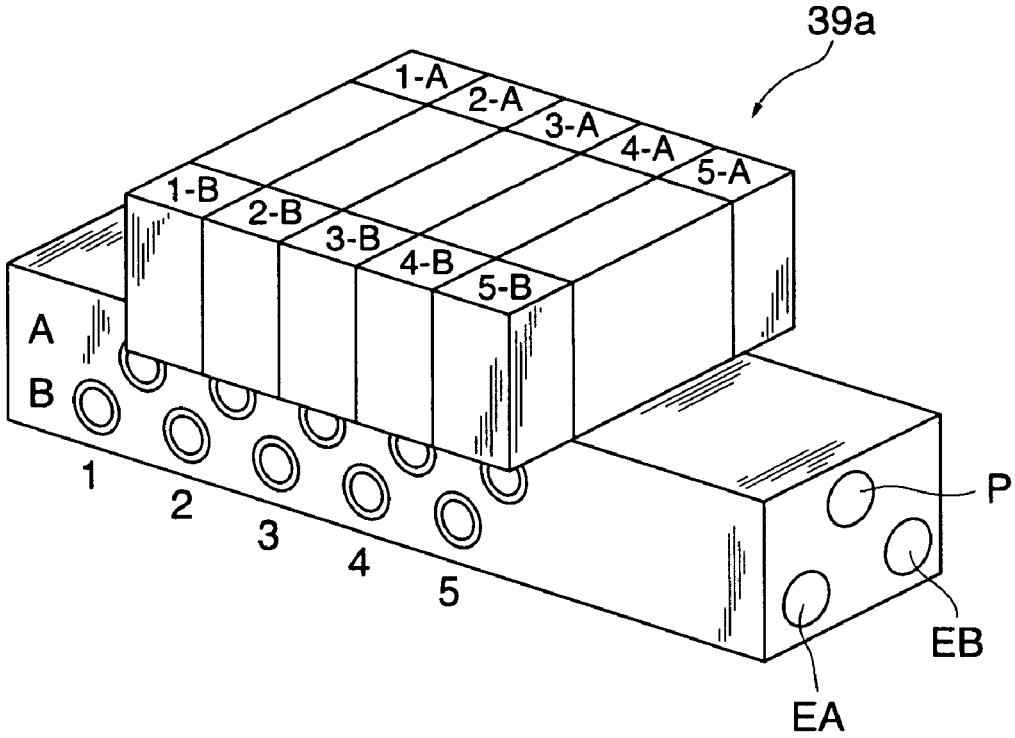
FIG. 16(A) is a diagrammatic perspective view thereof and FIG. 16(B) is a circuit diagram.
Figure 16B:
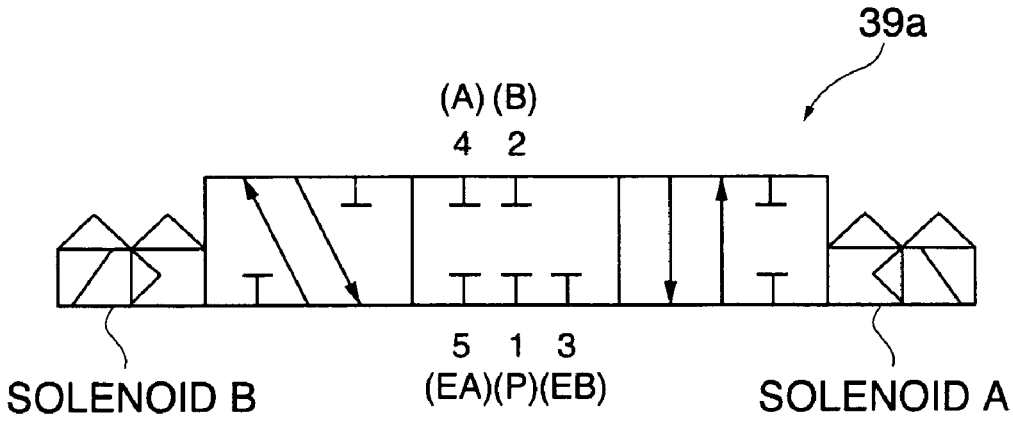

Shown in FIG. 16 is an electrostatic valve (three position, closed center double solenoid) 39*a* that is linked with an air compressor 39 to actuate vacuum generators 32, 33.

Next, operation of the automated hair-transplanting apparatus for wig manufacturing will be described in reference to FIG. 10 through FIG. 15. A slack T1 is first given between sheet feeding rollers 27 and tension nip rollers 24, 25 (FIG. 10(A)), and discharge roller 28 is driven to rotate to feed base 11 (FIG. 10(B)). Up to this time, tension nip rollers 24, 25 remains opened. Next, tension nip rollers 24, 25 are closed to hold the supplied base 11 therebetween, thereby again providing a slack T1 between sheet feeding rollers 27 and tension nip rollers 24, 25 (FIG. 10(C)). Then, sheet discharging rollers 28 are driven to rotate in a reverse direction to provide another slack T2 between tension nip rollers 24, 25 and sheet discharging rollers 28 (FIG. 10(D)). The total amount of the slacks T1 and T2 thus given should be enough to move conveyor table 21. The hatched portion of sheet slack sensor 29 in FIG. 10 indicates a detectable area. Base 11 is transferred from left to right.

Base 11 thus fed is nipped from top and bottom between tension nip rollers 24, 25 to become stretched on conveyor table 21 (see FIG. 4). Then, predetermined data designating a pitch of hair-transplantation, coloring of artificial hairs 30, etc. are read out by control means comprising a computer, not shown, according to which hair-transplanting process will start. The color scheme of artificial hairs 30 is determined in advance as a combination of 50% of the hair from bobbin 31A, 30% from bobbin 31B, 15% from bobbin 31C and 5% from bobbin 31D, for example.

Prior to the hair-transplanting process, artificial hairs 30 have been supplied to above base 11. Supply of artificial hair 30 is carried out by vacuum generators 32, 33 that are driven in response to a command from the control means to absorb by vacuum the thread. More specifically, when artificial hair 30 of "A" color is to be selected, ports "1-A" and "2-A" of electromagnetic valve 39*a* (shown in FIG. 16) in vacuum generator 32 are turned on, and a motor for bobbin 31A is turned on. When artificial hair 30 of "B" color is to be selected, ports "1-B" and "2-B" of electromagnetic valve 39*a* are turned on, and a motor for bobbin 31B is turned on. When artificial hair 30 of "C" color should be selected, ports "3-A" and "4-A" of electromagnetic valve 39*a* are turned on, and a motor for bobbin 31C is turned on. When artificial hair 30 of "D" color is to be selected, ports "3-B" and "4-B" of electromagnetic valve 39*a* are turned on, and a motor for bobbin 31D is turned on. When a thread sensor (not shown) comprising a photoelectric tube, for example, detects that the artificial hair 30 reaches a predetermined length, cutter 34 become operative to cut artificial hair 30 to a predetermined length. The artificial hair segment 30 thus cut is supplied to above base 11.

Then, artificial hair 30 is transplanted. First, movable guide 43 is moved to right to be connected with artificial hair supply nozzle 37 (FIG. 11(A)). At this time, press means 44, 45 remain opened. When artificial hair 30 is inserted into movable guide 43 (FIG. 11(B)), movable guide 43 is moved to left to separate from artificial hair supply nozzle 37 (FIG. 11(C)). Then, press means 44, 45 are closed substantially at the same time to hold artificial hair 30 into a horizontal orientation. While artificial hair 30 is temporarily fixed in such a manner, head 42 is driven by motor 47 to rotate about its axis. At the same time, needle 41 is driven by motor 49*b* in synchronism with motor 47 to rotate about its axis. Then, needle 41 moves upward. While artificial hair 30 is temporarily fixed by press means 44, 45, head 42 is driven by motor 46 to rotate as a pendulum toward needles 41 to describe an arc on the plane of base 11, and artificial hair 30 is forced against needle 41 (FIG. 11(D)), and then needle 41 moves down. An angle of this pendulum rotational movement of head 42 is determined in advance, which is detected by sensor 48*a*. During descent of needle 41, artificial hair 30 goes into engaging portion 41*c* of needle 41 and, therefore, artificial hair 30 is pulled out by needle 41 to below base 11. At this time, press means 44, 45 remain opened. Conveyor 51 is driven to rotate at a predetermined time interval, and the transplanted artificial hair 30 is raked to right by raking bars 53. This assures that next hair-transplanting operation may work well with no obstacles on the underside to be hair-transplanted. Transplantation of artificial hair 30 onto base 11 may be done at a predetermined travel pitch of 1 mm, for example, in a predetermined order, after conveyor table 21 has been moved in a direction of Y-axis (shown in FIG. 14) that is perpendicular to the direction of supply of artificial hair 30 (X-axis) or it has been moved in a direction of X-axis. By this, artificial hair 30 may be transplanted onto base 11 at a desired transplanting pitch P, P'. The transplanting pitch P. P', that is a spacing between artificial hairs 30, depends on the predetermined travel pitch of conveyor table 21. The transplanting pitch P, P' may not be constant in X-axis and Y-axis directions where conveyor table 21 make a turn, for example. Yet, this may rather provide a favorable condition comparable with the natural condition.

Figure 15A:
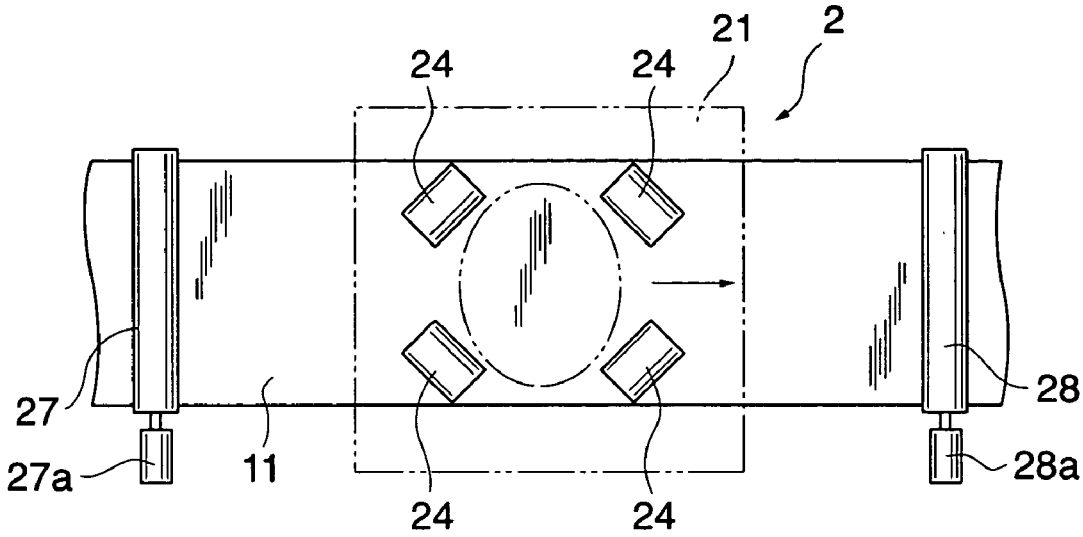
FIG. 15(A) and FIG. 15(B) are (diagrammatic plan) views explaining the process succeeding the hair-transplanting process.
Figure 15B:
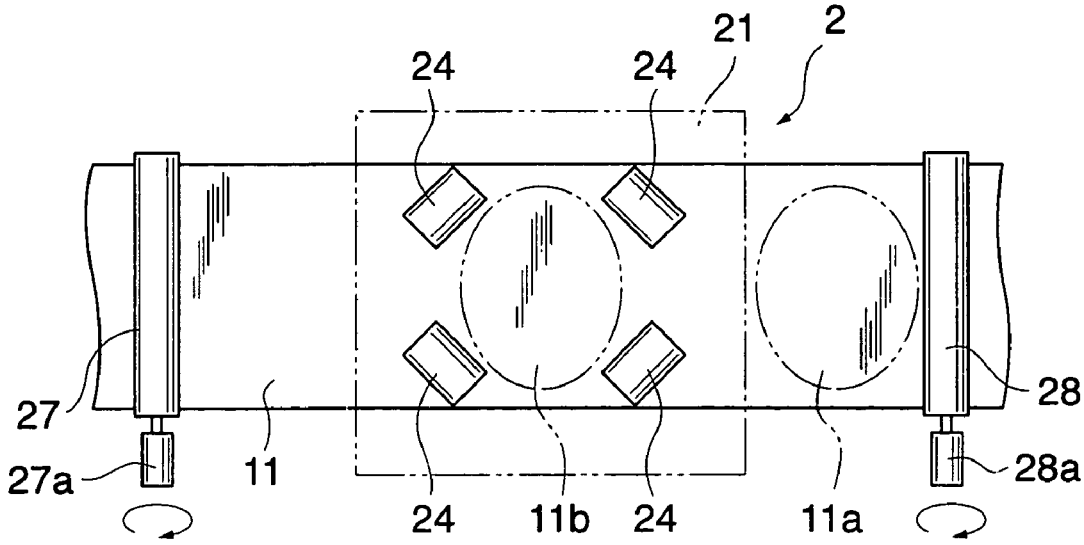

After completing the hair-transplantation in the above-described manner, the stretched condition of base 11 is released, and sheet-discharging rollers 28 are rotated to discharge the completed base 11*a* (FIG. 15(A)). Next, the base feeding process is again carried out in the aforementioned manner to feed a plane 11*b* as a new base 11 to be hair-transplanted (FIG. 15(B)).

The respective parts, described above, will be controlled by control means comprising a computer, not shown.

The hair-transplanting process will now be described in more detail. Because needle 41 has a leading end portion 41*a* shaped into an equilateral triangular pyramid, and there are edge(s) 41*b* on a periphery of leading end portion 41*a*, when needle 41 is to go through base 11, it will smoothly pierce base 11 without forcing base upward, resulting in substantially no vibration of needle 41.

Because engaging portion 41*c* of needle 41 for engaging artificial hair 30 has tongue 41*e* of a diameter smaller than guide surface 41*f*, tongue 41*e* will not get caught, during its descending movement, by the hem of a hole which has been formed by the ascending needle. Accordingly, needle will smoothly move down while artificial hair 30 is engaged and held in recess 41*d*.

Needle 41 is supported at two points, that is an upper point and a lower end point, by needle holders 41*g*, 41*h*. This is also contributable to preventing wobbling of needle 41.

As to the hooking of artificial hair 30, artificial hair 30 first makes contact with guide surface 41*f*, and then is guided along guide surface 41*f* to reach and is retained in recess 41*d* where guide surface 41*f* terminates. Artificial hair 30 engaged by recess 41*d* is subjected to the hooking after its opposite ends are cut away. At this time, the opposite end portions is not supported by artificial hair supply nozzle 37 and movable guide 43 and, therefore, needle 41 could move slightly due to some reason. However, since engaging portion 41*c* is provided just beneath leading end portion 41*a* and recess 41*d* is recessed in an axial direction, artificial hair 30 may be caught surely within recess 41*d*. Further, tongue 41*e* projects downward to cover recess 41*d* so that artificial hair 30 may be surely engaged by needle 41 without sway.

Accordingly, artificial hair 30 will be hooked surely.

Further, relative movement of needle 41 may be achieved at a pitch or width of high accuracy.

Accordingly, it becomes possible that the transplanting pitch of the artificial hair in automated wig manufacturing is controlled with high accuracy to be as equal to the human hair spacing, thereby reducing a percentage of production of defective articles when automatically manufacturing wigs. FIG. 2 also shows an example of application wherein base 11 with artificial hair 30 transplanted thereonto is formed into a three-dimensional one. More particularly, the discharged base 11 is next subjected to a first adhesive applying process B. Here, a first glue applicator 6 provides first glue 61 for securing the artificial hairs 30 that have been transplanted onto the top surface of base 11. More specifically, first glue applicator 6 comprises a tank 62, first glue 61 in tank 62, and a nozzle device 63 driven by air compressor 39 to jet first glue 61. At the hair-transplanting process A, it jets first glue 61 toward the base end portions 30*a* (shown in FIG. 9) of artificial hairs 30 remaining on the top surface of base 11 onto which artificial hairs 30 have been transplanted, thereby securing the base end portions 30*a* onto base 11. First glue 61 is of a quick-drying nature and contains a hardening agent for bearing heat and pressure applied at a forming process D to be described later.

Then, a cutting process C will be carried out. Here, base 11 to which first glue 61 has been applied is cut, by a cutter unit 7 comprising a cutter device 71, into a predetermined shape.

Then, the forming process D will be carried out. Here, base 11 thus cut by a forming unit 8 is subjected to heat and pressure to be formed into a predetermined shape. Forming unit 8 has, for example, a three-dimensional forming cavity 81 corresponding to a head size, and base 11 is transformed in conformity to forming cavity 81.

Then, a second adhesive applying process E will be carried out. Here, a second glue applicator 9 applies a second glue 91 onto the top surface of base 11. More specifically, second glue applicator 9 comprises a tank 92, second glue 91 in tank 92, and a nozzle device 93 driven by air compressor 39 to jet second glue 91. It jets second glue 91 onto first glue 61 that has been hardened, to form an adhesive layer (not shown) of the wig. Second glue 91 is of an adhesive nature that is fittable to the human skin, which may be one for medical use. Thus, the wig is completely manufactured and may be directly attached to the head.

Figure 17A:
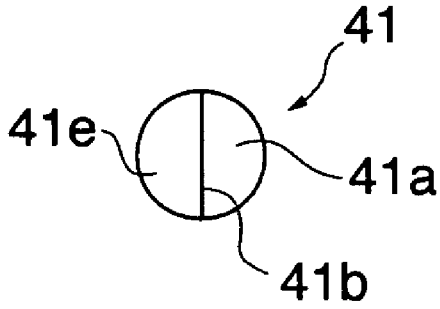
FIG. 17(A) is a plan view showing another embodiment of the needle for wig manufacturing according to the present invention and FIG. 17(B) is a front view of FIG. 17(A).
Figure 17B:
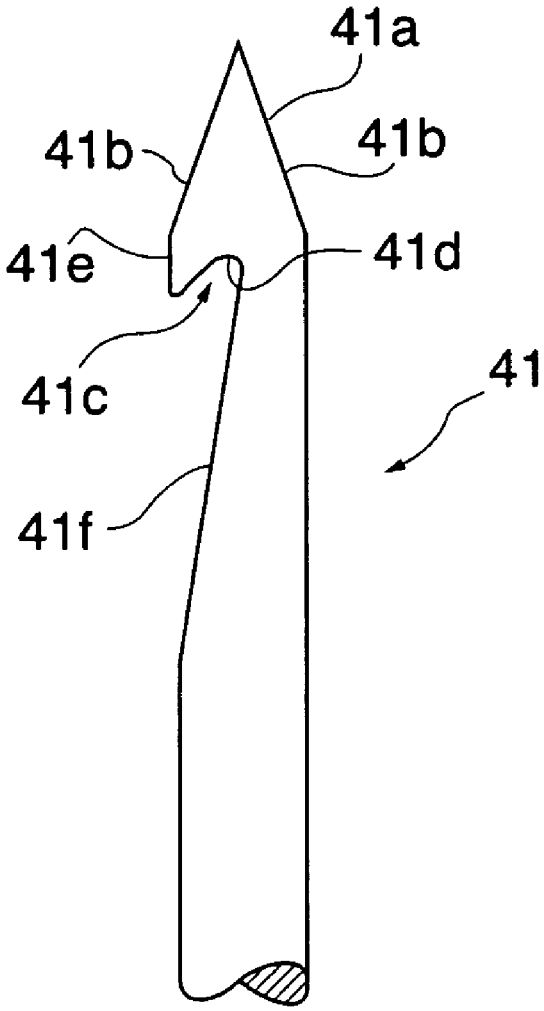

The present invention is not limited to the embodiments that have been described hereinabove and should be understood to have various variations and modifications without departing from the spirits and scope of the invention defined in the appended claims. For example, the shape of leading end portion 41*a* of needle 41 is optional, which may be another triangular pyramid or a polyangular pyramid with four edges 41*b* wherein edges may be formed along the respective ridges. It may be a conical one as shown in FIG. 17.

Direction of movement of needle 41 is optional. For example, needle 41 may be movable downward or movable rightward and leftward. In the former case, engaging portion 41*c* should be provided as an upward projection just above leading end portion 41*a*.

The number of edges 41*b* mounted on leading end portion 41*a* of needle 41 is optional, which may be two or four or more. Rather than providing plural edges, there may be only one radially extending edge as shown in FIG. 17.

The spacing between the respective edges may differ.

Figure 18:
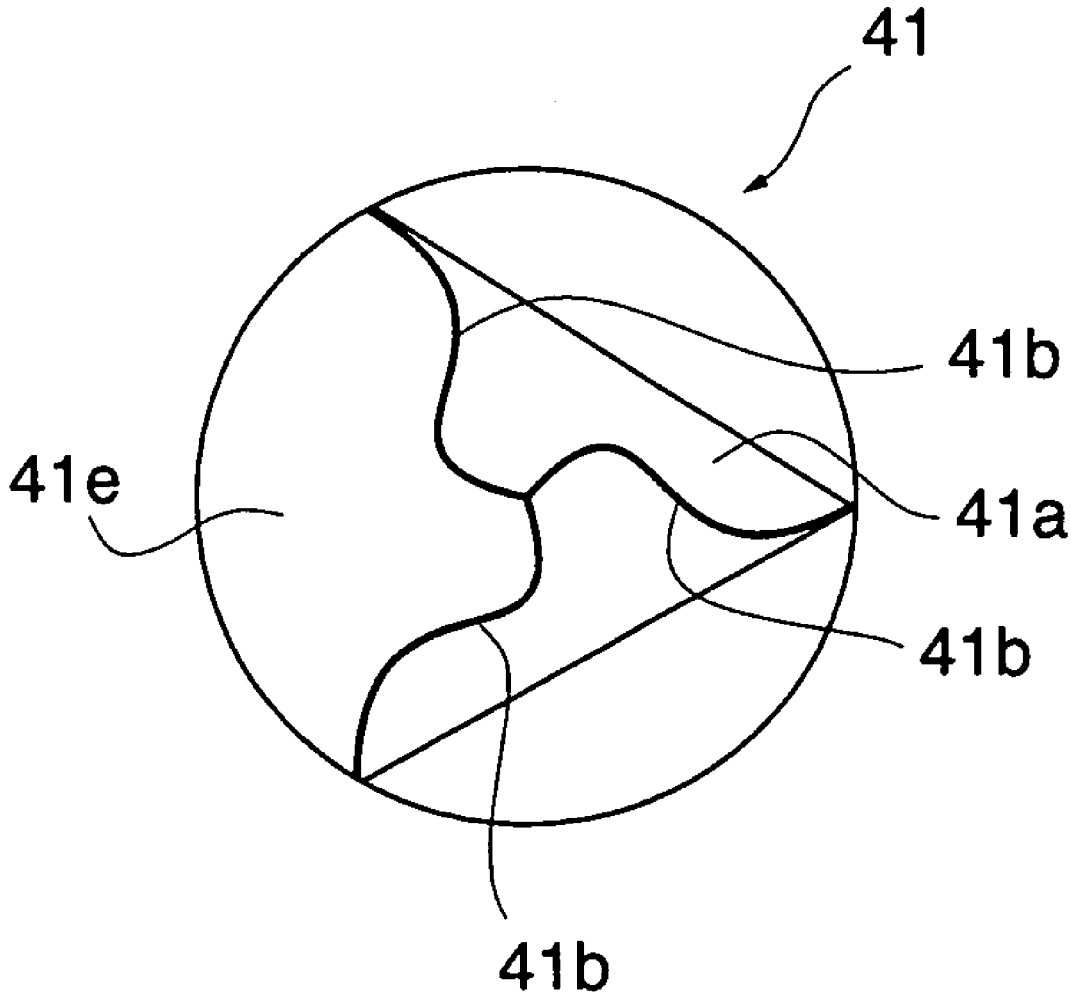
FIG. 18 is a plan view showing still another embodiment of the needle for wig manufacturing according to the present invention.

The shape of edges 41*b* is optional, which may be a screw-type one such as shown in FIG. 18.

In application to an automated hair-transplanting apparatus for wig manufacturing, the number of needles 41 is optional.

Needle 41 may be made from any desired material. Any material which provides necessary strength and is well resistant to bent and abrasion may be used.

The wig manufacturing apparatus and the wig manufacturing process to which the wig-manufacturing needle according to the present invention is applicable may be changed as desired. For example, as to the hooking of artificial hair 30, the opposite ends of artificial hair 30 may be supported continuously until it becomes hooked by recess 41*d* of needle 41.

It may be possible that needle 41 is a stationary member whereas base 11 is a vertically reciprocatable one.

The post-treatment following the hair-transplanting process is not limited to the above-described example, which may not involve the forming process and/or the cutting process.

The hair segment to be transplanted may be made from any desired material. This includes synthetic fiber, natural fiber, animal material, etc.

The invention claimed is:

1. A needle for manufacturing a wig, said needle to be used in an automated hair-transplanting apparatus for manufacturing a wig, said needle being extremely fine in its lengthwise direction and having a gimlet-shaped leading end portion provided with at least one edge on a periphery thereof and with an engaging portion at a base thereof, wherein there is a tapered guide surface extending from said engaging portion toward another end opposite to said leading end portion, said guide surface continuing straight from a point on a periphery of the needle to a recess of said engaging portion, said needle comprising a pair of needles of the same shape which vertically move together with respect to a base, said needle being supported at two points.

2. A wig-manufacturing needle according to claim 1 wherein said engaging portion comprises a recess and a tongue covering said recess.

3. A wig-manufacturing needle according to claim 2 wherein said recess is recessed in an axial direction of said needle.

4. A wig-manufacturing needle according to claim 2, wherein said tongue has a diameter smaller than the maximum diameter of said guide surface.

5. A wig-manufacturing needle according to claim 1 wherein said leading end portion is shaped like a polyangular pyramid.

6. A wig-manufacturing needle according to claim 5, wherein said leading end portion is shaped like a triangular pyramid.

7. A wig-manufacturing needle according to claim 1 wherein said leading end portion is shaped like a cone.

8. A wig-manufacturing needle according to claim 1 wherein there is a plurality of said edges.

9. A wig-manufacturing needle according to claim 1 wherein the number of said edges is three.

10. A wig-manufacturing needle according to claim 1 wherein the number of said edge is one.

11. A wig-manufacturing needle according to claim 8 wherein said edges are equally spaced with each other.

12. A wig-manufacturing needle according to claim 1 wherein said edge extends straight.

13. A wig-manufacturing needle according to claim 1 wherein said edge is a screw-like one.

14. A wig-manufacturing needle according to claim 1 wherein said needle is positioned below a base supplied to said automated hair-transplanting apparatus for wig manufacturing, wherein said needle cooperates with a head positioned above said needle to constitute a hair-transplanting unit of said automated hair-transplanting apparatus for wig manufacturing.

15. A wig-manufacturing needle according to claim 1 wherein said needle is vertically reciprocatable.

16. A wig-manufacturing needle according to claim 1 wherein said needle is stationary, whereas said base is vertically reciprocatable.

* * * * *